US007387744B1

(12) United States Patent
Mikhalev et al.

(10) Patent No.: US 7,387,744 B1
(45) **Date of Patent: *Jun. 17, 2008**

(54) METHOD OF MAKING MAGNETIC FLUID

(75) Inventors: Yuri O. Mikhalev, Ivanovo (RU); Tatiana A. Arefieva, Ivanovo (RU)

(73) Assignee: Ferrolabs, Inc., Dulles, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/858,089

(22) Filed: Dec. 20, 2007

Related U.S. Application Data

(63) Continuation of application No. 11/136,539, filed on May 25, 2005, now Pat. No. 7,291,287.

(51) Int. Cl.
*H01F 1/44* (2006.01)

(52) U.S. Cl. ..... 252/62.52

(58) Field of Classification Search ..... 252/62.52
See application file for complete search history.

(56) References Cited

U.S. PATENT DOCUMENTS 7,291,287 B2 * 11/2007 Mikhalev et al. ..... 252/62.52

* cited by examiner

*Primary Examiner*—C. Melissa Koslow
(74) *Attorney, Agent, or Firm*—Bardmesser Law Group

(57) ABSTRACT

The present approach pertains to colloidal chemistry and methods of manufacturing magnetic fluid such as ferrofluid. In particular, the present approach is directed to methods of manufacturing magnetic fluid that is resistant to aggregation and clumping, and is more stable over time. The process according to the present approach comprises sedimentation of magnetic particles; mixing the magnetic particles with an aqueous acetic acid solution, a surface-active agent and a polarizing composition; applying pulsed magnetic fields; removing excess surface-active agents and polarizing composition; ferrite desalination; and peptization of the surface-active agent in a non-polar, dispersing fluid. Magnetic fluids made according to the process of the present approach can be used, e.g., for ferrofluidic seals, inclinometers, accelerometers, or as magnetic lubricants.

18 Claims, 8 Drawing Sheets

METHOD OF MAKING MAGNETIC FLUID

CROSS-REFERENCE TO RELATED APPLICATIONS

This application is a continuation of U.S. patent application Ser. No. 11/136,539 filed on May 25, 2005, entitled METHOD OF MAKING MAGNETIC FLUID, now U.S. Pat. No. 7,291,287 which is incorporated by reference herein in its entirety.

FIELD OF THE INVENTION

The present approach pertains to colloidal chemistry and methods of manufacturing a magnetic fluid, such as a ferrofluid. In particular, the present approach is directed to methods of manufacturing a magnetic fluid that is resistant to aggregation and clumping, and is more stable over time.

BACKGROUND

Magnetic fluids are colloidal suspensions in which magnetic particles are dispersed in a fluid. The particles are typically coated with an amphiphilic surface-active agent that prevents the particles from aggregating. Surface-active agents are typically anhydrides of fatty acids with $C_{11}$-$C_{25}$ acid radicals. The polar portion of the surface-active agent form a coating on the magnetic particles by covalently bonding atoms at the surface of the magnetic particles. Such bonding is termed "chemosorption." The lipophilic portion of the surface-active agent extends radially away from the magnetic particle.

$C_7$-$C_{18}$ fatty acids are typically used as solvents for the anhydrides during the process of coating magnetic particles with surface-active agents. The fatty acids are not typically chemosorbed to the surface of the magnetic particles. The fatty acid used can optionally be a homolog of the surface-active agent.

To form the colloidal suspension, the particles are dispersed in a carrier, or dispersing fluid. The carrier fluid can be polyethylsiloxane fluids, such as those described by the general linear structural formula $M_2D_n$, where n is 1-8, M is $(C_2H_5)_3SiO_{0.5}$, and D is $(C_2H_5)_2SiO$. Alternatively, the fluid can be a synthetic olefinic polymer oil made of $C_5$-$C_{20}$ monomeric units. Combinations of polyethylsiloxane fluids and synthetic olefinic polymer oils can also be used as the carrier fluid.

The process of making an organosiloxane-based ferrofluid, such as polyethylsiloxane-based ferrofluid, is known. The process typically involves sedimentation of magnetic particles in an aqueous solution of ferric and ferrous salts, adding about 25-36% by volume of a solvent (e.g., ammonium hydroxide), rinsing the obtained sediment with acetone, followed by stabilization and peptization in a organosiloxane carrier fluid. See, e.g., Russian Patent No. RU 1621766, which is incorporated by reference in its entirety. Peptization is the process whereby sedimented magnetic particles are converted into a colloidal liquid.

Alternatively, ferrofluids can be made by sedimentation of finely dispersed magnetic particles in an aqueous solution of ferric and ferrous salts and aqueous ammonia. The obtained sediment is repeatedly rinsed with distilled water and then stabilized with a surface-active agent in an aqueous solution of acetic acid. While the mixture is warmed and stirred, the stabilized magnetic particles are first treated with a non-polar solvent, and then treated with a polar solvent. Ferrite desalination and excessive surface-active agent binding are monitored, and the product is peptized in a non-polar disperse environment. See, e.g., Russian Patent No. RU 2208584, which is incorporated by reference in its entirety.

Methods for the preparation of ferrofluids are described in U.S. Pat. No. 6,068,785, which is hereby incorporated by reference in its entirety. A number of books and references also discuss the subject of magnetic fluids, including their preparation. These include, e.g.: Magnetic Fluid Applications Handbook, B. Berkovsky, ed., Begell House, Inc., New York (1996); Ferrohydrodynamics, R. E. Rosensweig, Cambridge University Press, New York (1985); Ferromagnetic Materials—A Handbook on the Properties of Magnetically Ordered Substances, E. P. Wohlfarth, ed., Chapter 8, North-Holland Publishing Company, New York, and "Proceedings of the 7th International Conference on Magnetic Fluids," Journal of Magnetism and Magnetic Materials, Vol. 149, Nos. 1-2 (1995), all of which are hereby incorporated by reference in their entirety.

Ideal properties of magnetic fluids vary depending upon the application in which they are used. Important characteristics to consider include the fluid's minimum viscosity, maximum flux density before saturation, uniform size of the dipoles, degree of impurities, stability of its properties over time, stability of its properties over as wide a range of temperatures as possible, non-corrosivity, low coefficient of expansion, and, for applications where optical sensing of the movement of an inertial body is used, optical transparency. Many of these properties are difficult to achieve in combination.

Moreover, magnetic fluids produced by conventional methods have several disadvantageous properties. The limitations of such fluids include a high viscosity and low magnetization saturation. Such fluids are also unstable and prone to aggregation when stored over time (i.e., have a low aggregate stability). In particular, the magnetic particles of these fluids tend to associate and clump together.

It is believed that this instability is due to molecular desorption of any coating from the magnetic particles. This primarily occurs due to desorption of the anhydride coating. Desorption of fatty acids, fatty acid micelles, anhydride micelles and/or hybrid fatty acid/anhydride micelles can also occur and contribute to the instability. Any such desorption results in the deterioration of the protective coating, or film, which prevents interparticle aggregation. Desorption of the surface-active agents also results in the formation of surface-active agent micelles, as shown in FIG. 1B. Such micelles are aggregates of amphiphilic surface-active agent molecules (FIG. 1A) whose polar groups form the micelle core surrounded by a layer of non-polar hydrocarbon radicals. Cohesion forces among such surface-active agent molecules are believed to be due to dipole-dipole interaction between ion pairs and possible hydrogen bonds. The extent of coating can be determined based on viscosity characteristics of the magnetic fluid.

During the manufacture of the magnetic particles, solubilization of the surface-active agent anhydrides by the fatty acid solvent further exacerbates the instability of conventional magnetic fluids. Such solubilization reduces the ability of surface-active agent molecules to coat the magnetic particles. For example, where surface-active agent micelles have formed, fatty acid solvent molecules wedge between surface-active agent molecules, so that their polar groups face the micelle core, and their non-polar parts align in parallel to hydrocarbon radicals of the surface-active agent, as in FIG. 2B. Hybrid micelles composed of surface-active agent and solvent molecules are formed (FIG. 3), grow larger in size and become bulkier. Additional energy is needed for a surface-active agent molecule to escape from such a hybrid micelle, and is thus less likely to form a coating on a magnetic particle.

Solubilized surface-active agent micelles or hybrid micelles also create the potential for undesired physical adsorption to occur at the magnetic particle surfaces. Since chemosorption of individual surface-active agent molecules is complicated, physical adsorption of surface-active agent micelles, as shown in FIG. 4, is possible. Physical adsorption of surface-active agent micelles or hybrid micelles onto magnetic particle surfaces happens due to Van der Waals forces. In contrast to chemosorption, physical adsorption does not result in the formation of covalent bonds. Physical adsorption is a problem both during the manufacture of the magnetic fluid as well as during its storage. Such intermolecular forces have an action range from about 1-100 nm, have unsaturated interionic bonds, and bond energies of about 10-40 kJ/mol. Because the bond energy of physical adsorption is considerably smaller than that of chemosorption (chemosorption bond energy can reach 400 kJ/mol), micelles adsorbed to the surface of magnetic particles are easily desorbed. Such desorption further contributes to the low aggregational stability in that the particles are prone to losing their coatings.

Whether by formation of micelles or solubilization, desorption of surface-active agent molecules leads to reduction of the magnetic particles' protective film or coating. As the particles lose their coating of surface-active agent molecules, they become more prone to approach one another and aggregate, as depicted in FIG. 5. Colloidal suspensions of such particles are very unstable, inhomogeneous, and have low magnetic flux saturation values.

Accordingly, there is a need in the art for colloidal magnetic fluids that have high aggregational stability (i.e., magnetic fluids that do not form aggregates). The present approach addresses these problems by describing a method of manufacturing magnetic fluids that allows better surface-active agent adsorption on magnetic particles. Such particles have denser protective coats, or films, and provide colloidal suspensions having greater aggregational stability.

BRIEF SUMMARY OF THE INVENTION

The present approach is directed to a method of making a magnetic fluid involving: a) forming a mixture comprising a surface-active agent and a polarizing composition; and b) adding the mixture to magnetic particles. The resulting magnetic fluid contains magnetic particles coated with surface-active agents.

The surface-active agent can be an anhydride of a $C_2$-$C_{20}$ fatty acid. In one embodiment of the present approach the surface-active agent can be stearic anhydride, lauric anhydride, margaric anhydride, palmitic anhydride, oleic anhydride, enanthic anhydride, myristic anhydride, pelargonic anhydride, caprylic anhydride, valeric anhydride, linoleic anhydride, mystiric anhydride, or combinations thereof.

The mixture of surface-active agent and polarizing composition can also include stearic acid, lauric acid, margaric acid, palmitic acid, oleic acid, enanthic acid, myristic acid, pelargonic acid, caprylic acid, valeric acid, linoleic acid, mystiric acid, butanoic acid, decanoic acid, elaidic acid, heptanoic acid, hexanedioic acid, hexanoic acid, isobutyric acid, isocaproic acid, isolavenic acid, n-butyric acid, nonanoic acid, octaduenoic acid, ricinoleic acid, undecanoic acid, unolic acid or combinations thereof.

The polarizing composition can be a $C_4$-$C_{10}$ alcohol and/or an ether of $C_4$-$C_{10}$ alkyl residues. In one embodiment of the present approach, the polarizing composition can be butyl alcohol, butyl ether, hexyl alcohol, oleic acid, valeric acid and heptyl alcohol.

The polarizing composition to surface-active agent ratio can be about 0.4-0.6 to 1, or roughly a ratio of 1:2 (or, equivalently, the ratio of surface-active agent to polarizing composition can be between 1:1.66 and 1:2.5).

The present approach also involves applying pulsed magnetic fields while adding the surface-active agent to the magnetic particles. In one embodiment of the present approach, the pulsed magnetic fields have an amplitude of about 0.3 Tesla and a duration of at least 0.1 seconds.

The magnetic particles can be iron oxide, cobalt, gadolinium, nickel, dysprosium, manganese, ferrite, zinc ferrite and cobalt ferrite.

The surface-active agent coated magnetic particles can be dispersed in a carrier liquid, which can be a polar or non-polar organic solvent. Surfactants and/or stabilizers can also be added. The carrier liquid can be water or an organic solvent. Non-limiting examples of organic solvents useful according to the present approach include kerosene, heptane, toluene, hydrocarbons, polyglycols, fluid siloxane containing block copolymer, or combinations thereof. The carrier liquid can also be a polyethylsiloxane fluids described by the general linear structural formula $M_2D_n$, where n is 1-8, M is $(C_2H_5)_3SiO_{0.5}$, and D is $(C_2H_5)_2SiO$.

In one embodiment, the mixture is formed from a first solution of surface-active agent maintained at about 150° C. to about 160° C. and a second solution of polarizing composition maintained at about 90° C. In another embodiment of the present approach, the mixture is maintained at about 90° C. to about 160° C. prior to adding the mixture to the colloid. In another embodiment of the present approach, the mixture is maintained at about 90° C. to about 140° C. prior to adding the mixture to the colloid. In another embodiment of the present approach, the mixture is maintained at about 150° C. to about 160° C. prior to adding the mixture to the colloid.

The present approach is also directed to a method of making a magnetic fluid comprising simultaneously adding a surface-active agent, a polarizing composition and an aqueous acetic acid solution to magnetic particles; and applying pulsed magnetic fields. Alternatively, the surface-active agent and polarizing composition can first be mixed together, and then simultaneously mixed with the aqueous acetic acid solution and the magnetic particles in the presence of a pulsed magnetic field.

The present approach is also directed to a method of making a magnetic fluid comprising contacting magnetic particles with a chemically polarized surface-active agent; and applying pulsed magnetic fields.

The present approach is also directed to magnetic fluids made according to the methods described herein.

It is to be understood that both the foregoing general description and the following detailed description are exemplary and explanatory and are intended to provide further explanation of the invention as claimed.

BRIEF DESCRIPTION OF THE FIGURES

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Figure 1B:
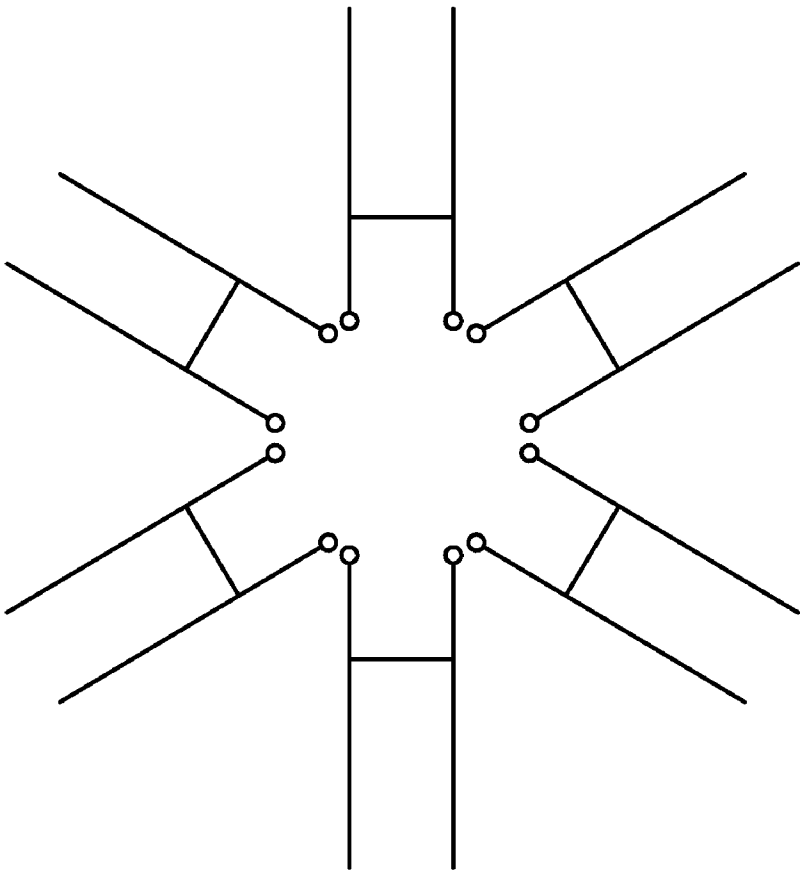
FIG. 1B Conventional Art
FIG. 1B illustrates an anhydride surface-active agent micelle with polar head groups (circles) at the center and lipophilic hydrocarbon chains extending radially outward from the center.
Figure 1A:
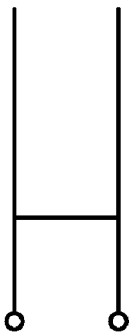
FIG. 1A Conventional Art
FIG. 1A illustrates an anhydride surface-active agent molecule with two lipophilic hydrocarbon chains and two polar head groups (circles).
Figure 2B:
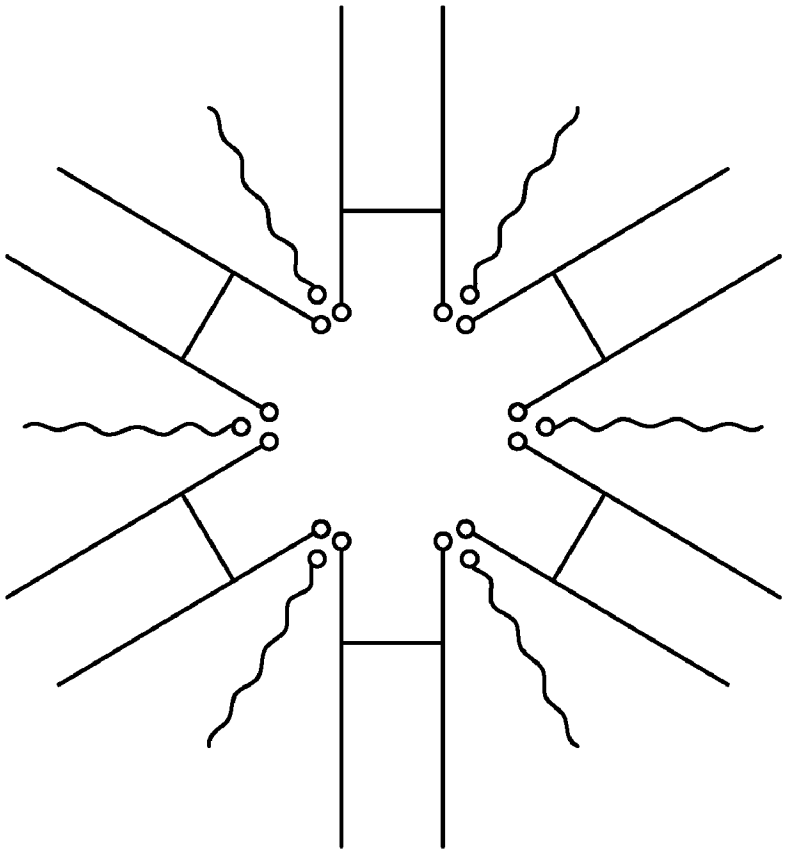
FIG. 2B Conventional Art
FIG. 2B illustrates the process of solubilization of an anhydride surface-active agent micelle with solvent molecules to form a hybrid surface-active agent/solvent molecule micelle.
Figure 2A:
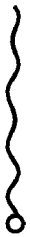
FIG. 2A Conventional Art
FIG. 2A illustrates a solvent fatty acid molecule having a polar head group (circle) and a lipophilic hydrocarbon tail.
Figure 3:
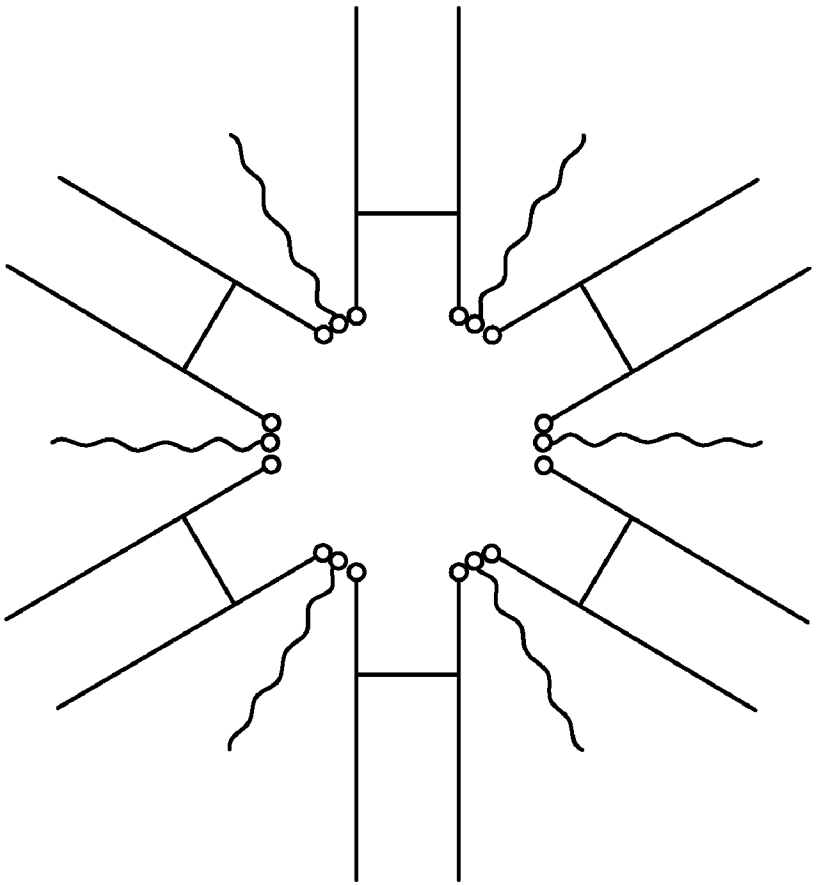
FIG. 3 Conventional Art
FIG. 3 illustrates a hybrid micelle formed of anhydride surface-active agents and solvent molecules.
Figure 4:
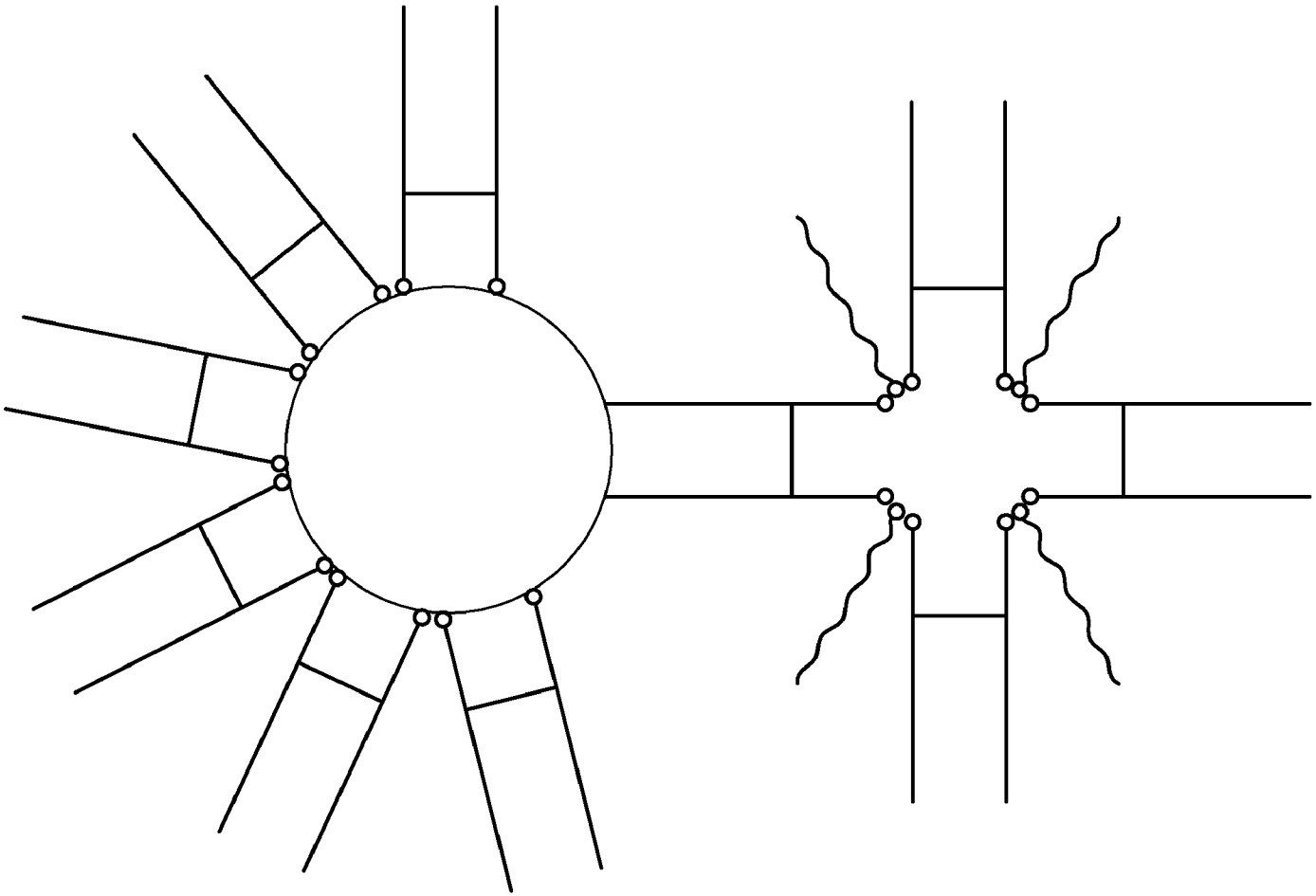
FIG. 4 Conventional Art
FIG. 4 illustrates a magnetic particle with partial chemosorbed surface-active agent coating and partial coating of physically adsorbed surface-active agent/solvent hybrid micelle.
Figure 5:
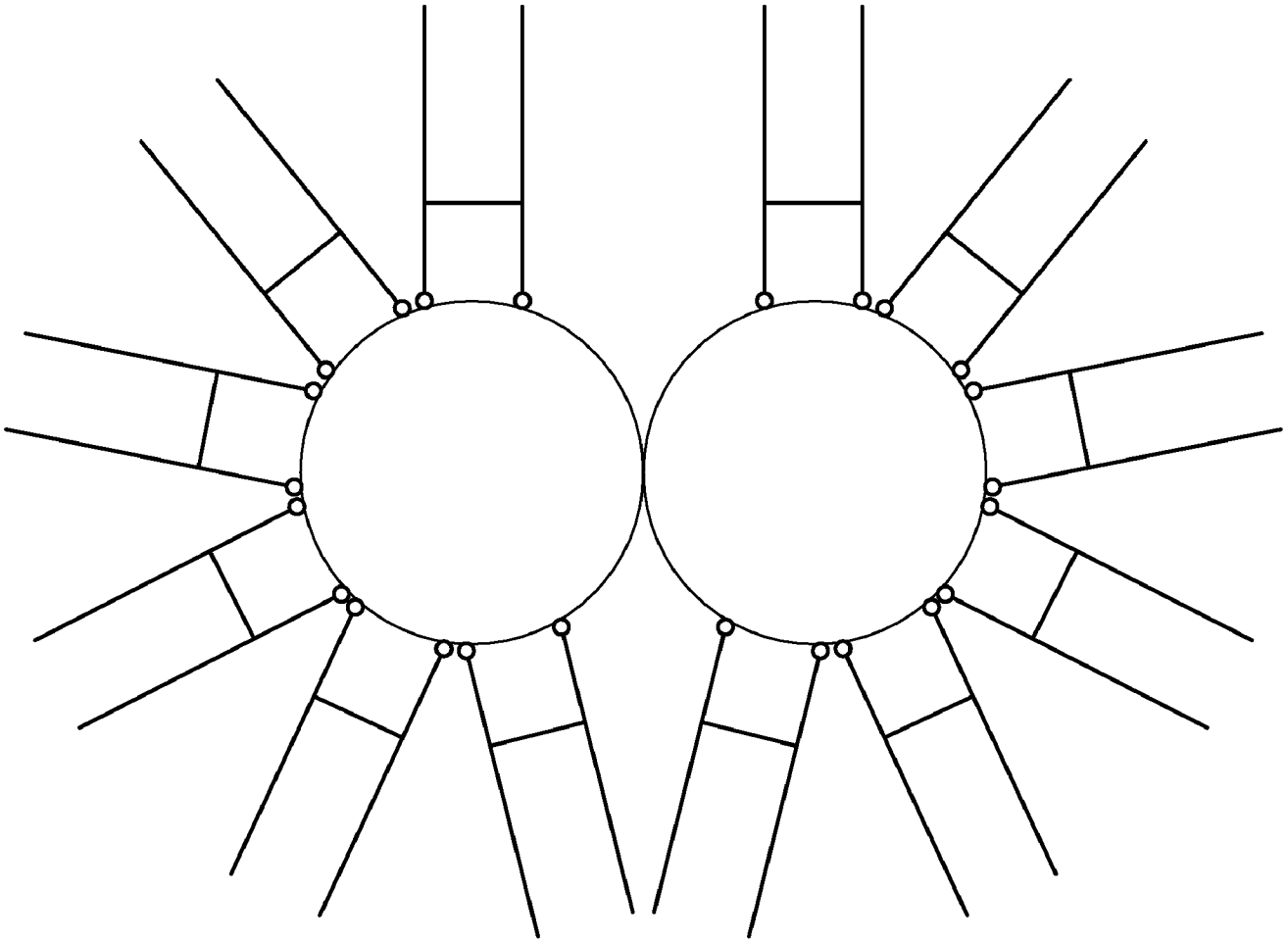
FIG. 5 Conventional Art
FIG. 5 illustrates two magnetic particles approaching each other after partial desorption of coating.

Reference will now be made in detail to embodiments of the present invention, examples of which are illustrated in the accompanying drawings.

The present approach is directed to a method of manufacturing magnetic fluid that can be used, for example, for ferrofluidic seals, inclinometers, accelerometers, or as a magnetic lubricant.

More particularly, the present approach is directed to manufacturing magnetic fluid that is resistant to aggregation and clumping, and is more stable over time. One of the parameters of quality of magnetic liquid is its stability over time and resistance to aggregation ("aggregational stability"). A problem common to conventional magnetic fluids is that the individual magnetic particles in the fluid, such as ferrite particles, aggregate or clump together over time, thereby forming larger and larger particles. This tends to degrade the quality of the magnetic fluid.

Magnetic fluid is not a true mixture, but is a colloidal suspension. Therefore, to prevent aggregation, clumping, or sedimentation of the particles, it is necessary for Brownian motion to be able to push apart the particles, counteracting their tendency to aggregate. This means that the energy of the Brownian motion must be greater than the energy of the magnetic particles due to gravity, or due to the magnetic field. This can also be referred to as "kinetic stability." If the particles were allowed to clump, or aggregate together into larger "units," the energy due to the Brownian motion would no longer be sufficient to counteract the effect of gravity or the effect of the applied magnetic field, and the particles would sediment to the bottom (due to gravity), or would tend to collect unevenly in certain locations, particularly in regions in a high magnetic field. Any such causes of aggregation results in magnetic fluid inhomogeneity and poor performance of whatever device in which the magnetic fluid is used.

Thus, the present approach is directed to addressing the problem of aggregational stability. This is done by coating the surface of the particles with surface-active agents that resist aggregation. Thus, the addition of a coating gives the magnetic particles an elastic/repulsive property.

The surface-active agents are molecules having two regions: i) a polar head that covalently attaches to the surface of the magnetic particle, and ii) a hydrocarbon tail. The effective size of the overall magnetic particle, including the surface-active agent coating, depends on how thoroughly and uniformly the heads attach themselves to the surface of the magnetic particles. Theoretically, the thickness of the coating of the surface active ingredient should be equal to the length of the molecule. However, the effective thickness depends on the uniformity of the distribution of the molecules of the surface-active agent on the surface of the magnetic particle.

Typical magnetic particles are on the order of six to ten nanometers across, and a typical thickness of the coating is on the order of 1.5 to 2 nanometers. Because of the impracticality of measuring single particles, these measurements represent averages, or distributions, and not measurements of individual particles. The skilled artisan is familiar with measurement techniques which include, for example, Raman laser light scattering.

The present approach is directed to providing as dense as possible a coating of surface-active agent on the magnetic particles.

In order for the magnetic fluid to work at high temperatures, the binding energy between the surface-active agent and the magnetic particle must be high enough that the surface-active agent does not dissociate from the magnetic particle. The surface-active agent can physically or chemically adsorb to the surface of the magnetic particles, or chemically react with the magnetic particles. Physical and chemical adsorptions are associations between surface-active agents and magnetic particles' surface atoms. In contrast to physical adsorption, chemical adsorption results in the formation of covalent bonds between the surface-active agents and atoms at the surface of the magnetic particles. Chemical reactions between surface-active agents and magnetic particles can also form covalent bonds with non-surface atoms of the magnetic particles.

Physical and chemical adsorption are associations between surface-active agents and magnetic particles that form coatings upon the magnetic particles. The binding energy of physical adsorption corresponds to approximately 60° C. That is, at 60° C., surface-active agents physically adsorbed to the surface of magnetic particles begin to dissociate from the magnetic particles. In contrast, the binding energy of chemical adsorption is such that surface-active agents begin to dissociate from the surface of the magnetic particle at about 160° C. Chemically adsorbed surface-active agents have greater stability relative to physically adsorbed surface-active agents at higher temperatures due to the covalent bonds that form during chemical adsorption.

Chemical reactions between surface-active agents and magnetic particles can also result in chemical transformation of the magnetic particles extending beyond their surface. The binding energy associated with covalent bonds resulting from such chemical reactions corresponds to about 1000° C.

However, for most practical applications, at such relatively high temperatures the chemistry of the magnetic particles themselves will start changing, and very few applications where magnetic fluid is used require temperatures on the order of 1000° C. Thus, for most practical applications, the magnetic fluid needs to be stable at temperatures from about 100° C. to about 150° C. Hence, it is desirable to maximize the amount of chemical adsorption of surface-active agent at the surface of the magnetic particles.

The present approach is also directed to maximizing the surface area of the magnetic particles at the time they are being coated with surface-active agents. This is achieved by applying pulsed magnetic fields when bringing the surface-active agents into contact with the magnetic particles. When no magnetic field is applied to the mixture containing the magnetic particles, the sum of the magnetic moments of the magnetic particles is essentially zero, since they are oriented randomly. However, when a magnetic field in the form of an impulse is applied, the magnetic moments of the magnetic particles are rapidly forced into an aligned orientation, which generates a force that drives the aggregations of the particles apart. This dissociation of the magnetic particles from one another exposes more surface area of the magnetic particles to which the surface-active agent may be chemically adsorbed.

The surface-active agent can form micelles in which the polar head groups associate at the core with the hydrocarbon tails extending radially outward. See FIG. 1B. Such micelle formation is a problem both during manufacture of the magnetic particles and during their storage. Surface-active agent molecules that form part of a micelle are not free to be chemically adsorbed at the surface of the magnetic particles. Such surface-active agents need to be dissociated from the micelles. In order to break up the micelles into the individual molecules of surface-active agent, polarizing compositions are added. Freed surface-active agents can then be chemically adsorbed and used to form a coating on the magnetic particles. Hence, the present approach is also directed to utilizing polarizing compositions to provide greater surface-active agent molecule coating on the surface of magnetic particles.

Freeing individual surface-active agents from micelles is achieved by the process of chemical polarization. Chemical polarization refers to the process of increasing the polarity of the surface-active agent molecules. As the surface-active agent becomes more polar, it increases its functional activity and is better able to be chemosorbed at the surface of a magnetic particle. The surface-active agent molecules' polarity is increased by mixing them with the polarizing compositions.

Prior to mixing the surface-active agent molecules with the polarizing compositions, the polarity of the surface-active agent molecules is a function of the electronegativity of its atoms and their relative spatial arrangement. Different atoms have different electronegativities (i.e., affinities for electrons), as shown in Table 1.

TABLE 1

Electronegativity of some elements

| Elements | H | C | N | O | S |
|---|---|---|---|---|---|
| Electronegativity | 2.1 | 2.5 | 3 | 3.5 | 2.5 |

These differences establish net dipole moments resulting from vector sums of individual covalent bond moments. Because the surface-active agents' polar head group (also referred to as the "active group") have atoms of greater electronegativity than the atoms making up the lipophilic hydrocarbon tail, there is a net dipole moment with greatest electronegativity located at the active group. The greater the electronegativity of the active group, the better are its functional properties, and the better it is able to covalently bind to the magnetic particles' surface.

Figure 7:
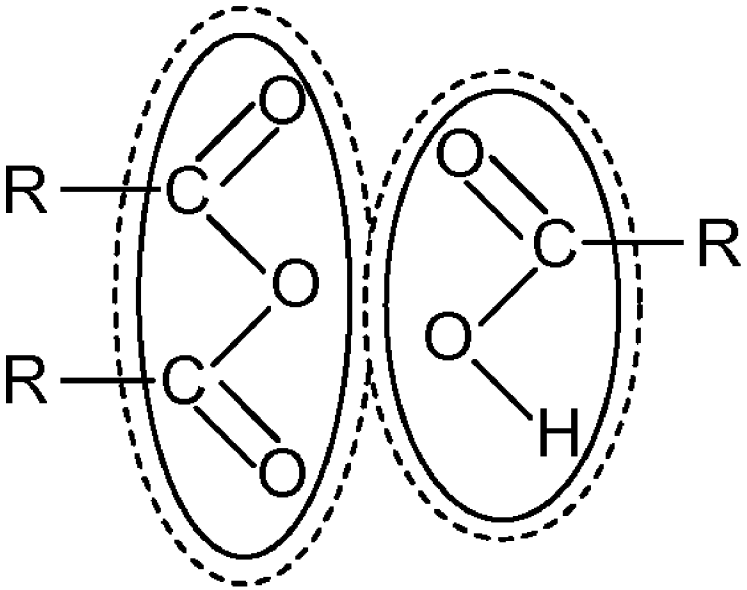
FIG. 7 illustrates chemical polarization of a surface-active agents by a polarizing composition.

Polarizing compositions influence the polarity of other polar compounds. See, e.g., Shekhter Y. N., Krein L. N., Teterina L. N. Oil-soluble surface-active agent, Chemistry Publishing House, Moscow, Russia, pp. 197-253 (1978). According to the present approach, the electron density shell of the active groups undergoes polydimensional deformation in the presence of polarizing compositions. This deformation is caused by the electronegativity of the active group that attracts electrons of the polarizing composition. Electrons are not completely passed from the shell of an atom on the polarizing composition to the shell of an atom on the active group, but polydimensional deformation of electron shells occurs. The association of these shells results in an increase in size and/or density of electron shells around the active group, as depicted in FIG. 7. The higher the electron density of the polarizing composition, the greater the polydimensional deformation of the electron shell around the active group of the surface-active agent. The greater the electron shell density around the active group, the higher its polarity and its ability to bind to the magnetic particles' surface.

Figure 6B:
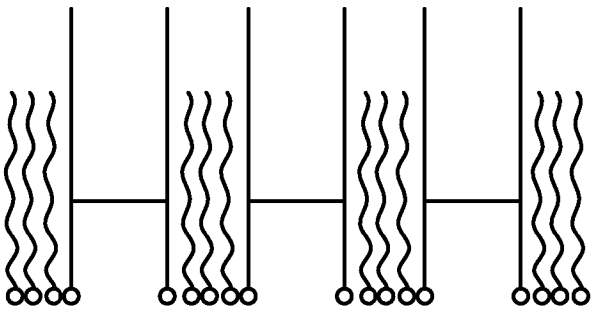
FIG. 6B illustrates dividing a hybrid micelle into its separate molecules using polarizing compositions.
Figure 6A:
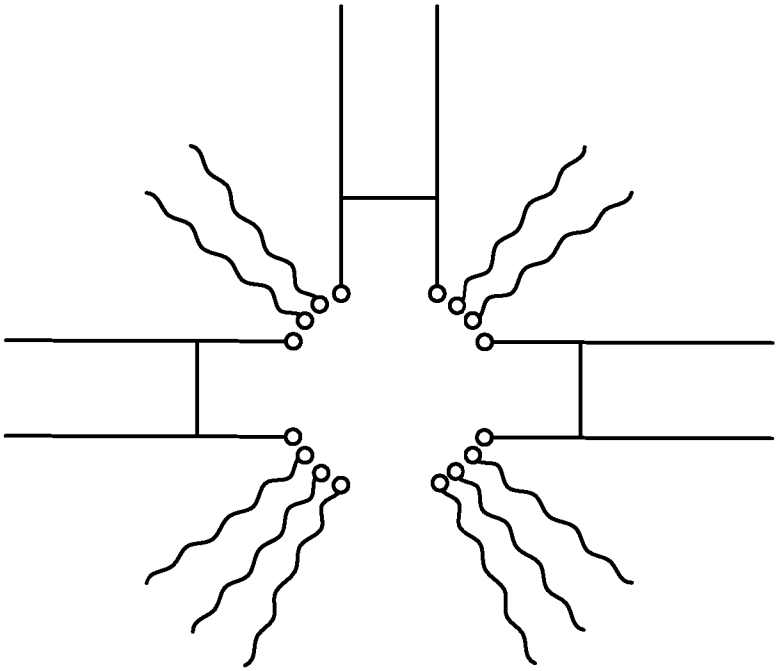
FIG. 6A illustrates breaking a hybrid micelle using polarizing compositions.

Mixing surface-active agent molecules with polarizing compositions also advantageously reduces the formation of surface-active agent micelles. The polarizing composition, by interacting with the surface-active agent molecules, breaks the micelles, as depicted in FIG. 6.

Ratios ranging from 0.1-0.3 to 1 are usually insufficient to break up the micelles or to increase the functionality of the surface active agent. Although it is possible to increase the ratio above 0.6 to 1, the amount of polarizing composition needed to be removed from the final colloidal product (using organic solvents) also increases. If the polarizing compositions are not removed, formation of gel-like compositions and an increase in viscosity is possible.

The chemically polarized surface-active agent molecules are easily adsorbed on the surface of magnetic particles, and a chemosorptive bond is formed. Since the energy of molecular interaction between the polarizing composition and the surface-active agent is very small, the polarizing composition is easily removed after the surface-active agents have been bound to the magnetic particles. Removal of the polarizing compositions is facilitated by rinsing the magnetic particles with a polar compound.

Preferred organic compounds that can be used as the surface-active agent include anhydrides of fatty acids with acid radical size of $C_{11}$-$C_{25}$. Other non-limiting examples of surface-active agents that can be used according to the present approach include those described by U.S. Pat. Nos. 4,554,088, 5,013,471, 5,143,637, 5,676,877 and 6,261,471, all of which are hereby incorporated by reference in their entirety.

Different types of organic compounds can be used as the polarizing composition. Non-limiting examples include acetic acid, fatty acids, alcohols, ethers, esters, or mixtures thereof. The polarizing composition can be one or more fatty acids having a $C_2$-$C_6$ carbon chain, preferably a $C_2$-$C_4$ radical length. In another preferred embodiment, the polarizing composition can be one or more $C_4$-$C_{10}$ alcohol. In another preferred embodiment, the polarizing composition can be ethers of $C_4$-$C_{10}$ hydrocarbons.

Magnetic particles useful according to the present approach include ferro- or ferri-magnetic material capable of being magnetically ordered. It may be a metal, a metal alloy or an M-type or spinel ferrite. The metal, metal alloy or ferrite may contain one or more of the following: aluminum, barium, bismuth, cerium, chromium, cobalt, copper, dysprosium, erbium, europium, gadolinium, holmium, iron, lanthanum, lutetium, manganese, molybdenum, neodymium, nickel, niobium, palladium, platinum, praseodymium, promethium, samarium, strontium, terbium, thulium, titanium, vanadium, ytterbium, and yttrium.

Magnetic particles useful according to the present approach also include iron oxide ($Fe_3O_4$) particles. Typical diameters of $Fe_3O_4$ particles is on the order of 10-20 nanometers (or smaller). The $Fe_3O_4$ particles are generally spherical in shape, and act as the magnetic dipoles when the magnetic field is applied. Other iron oxides include $FeO_2$, $Fe_2O_3$. Other magnetic particles that can be used according the present approach include manganese zinc ferrite ($Zn_xMn_{1-x}Fe_2O_4$), cobalt ferrites, or other ferromagnetic alloys, oxides and ferrites.

To form the colloidal suspension, the particles are then dispersed in a dispersing fluid (also referred to as a "carrier fluid"). The dispersing fluid of the magnetic fluid is selected so as to disperse the solid particles within the colloidal suspension. The dispersing fluid can be a mixture of fluids.

Such fluids can be alkylsiloxane fluids, or polyethylsiloxane fluids, such as those described by the general linear structural formula $M_2D_n$, where n is 1-8, M is $(C_2H_5)_3SiO_{0.5}$, and D is $(C_2H_5)_2SiO$. Alternatively, the carrier fluid can be a synthetic olefinic polymer oil made of $C_5$-$C_{20}$ monomeric units. Combinations of polyethylsiloxane fluids and synthetic olefinic polymer oils can also be used. The carrier fluid is generally added as a last step, after the magnetic particles have been stabilized with the surface active ingredient.

Other non-limiting examples of dispersing fluids include water or organic solvents such as kerosene, heptane, toluene, hydrocarbons, polyglycols, or fluid siloxane containing block copolymer.

The dispersing fluid may further comprise surfactants and/or other dispersing agents to stabilize the magnetic particles, such as those described in U.S. Pat. No. 6,464,968, which is hereby incorporated by reference in its entirety. Such stabilizers include block copolymers comprising "anchor" blocks that strongly adsorb onto the magnetic particle surface, and "tail" blocks which protrude into the medium. The chemical structure of the "tail" block of the block copolymer stabilizer should be related to the structure of the dispersing fluid such that it is soluble in the dispersing fluid. Thus, for a polydimethylsiloxane carrier fluid, a preferred "tail" chemical structure of the block copolymer stabilizer is itself a polydimethylsiloxane block. Alternatively, if the dispersing fluid is a poly(trifluoropropylmethylsiloxane), a preferred copolymer stabilizer might have a trifluoropropylmethylsiloxane tail block. Di- or triblock copolymers are preferred having a poly(3-cyanopropyl)methylsiloxane (PCPMS) "anchor" block bound to at least one polydimethylsiloxane (PDMS) "tail" blocks.

The present approach is directed to a method of making a magnetic fluid comprising chemically polarizing the surface-active agent by addition of a polarizing composition prior to magnetic particle stabilization, and performing the magnetic particle stabilization under pulsed magnetic fields.

In general, the process of producing a magnetic fluid according to the present approach involves the mixing of the following components in the presence of a pulsed magnetic field: i) a preparation of water-bourne sediment of magnetic particles, ii) one or more surface-active agents, iii) one or more polarizing composition; and iv) an aqueous acetic acid solution.

Because they are smaller than the surface-active agents, acetic acid molecules are the first to be absorbed onto the surface of the magnetic particles. Once adsorbed onto the surface of the particles, the acetic acid interacts with non-magnetic iron compounds, which are also on the surface of the particles. This interaction proceeds with formation of iron acetates, which are ultimately removed with hot distilled water. Therefore, these non-magnetic iron compounds are effectively removed from the magnetic particles' surface. The removal of these non-magnetic iron compounds prepares the surface for better adsorption of the surface active agent. Any remaining magnetic particle-bound acetic acid is displaced by the surface-active agent.

The present approach is also directed to a method of making a magnetic fluid comprising simultaneously adding a surface-active agent, a polarizing composition and an aqueous acetic acid solution to magnetic particles; and applying pulsed magnetic fields. Alternatively, the surface-active agent and polarizing composition can first be mixed together, and then simultaneously mixed with the aqueous acetic acid solution and the magnetic particles in the presence of a pulsed magnetic field.

The ratio of aqueous suspension of magnetic particles to aqueous solution of acetic acid is about 1:2, although this ratio can be increased to about 1:1. At ratios of 2:1, the thickness of the surface active coating decreases to about 1 nm due to reduced adsorption properties of the surface active agent.

The suspension of the magnetic particles to the surface active agent and the polarizing composition is preferably around 3:1. Lowering the ratio down to 1:1 makes it difficult to remove the excess surface active agent and the polarizing composition later. Increasing the ratio to, e.g., 15:1 usually leads to a reduction of the surface active coating thickness of to 1 nm, since there is an insufficient amount of the surface active agent to start with.

In one embodiment, the present approach is directed to a method of producing a magnetic fluid comprising:

i) sedimentation of magnetic particles;

ii) mixing the magnetic particles with a) one or more surface-active agents, b) one or more polarizing composition; and c) an aqueous acetic acid solution;

iii) applying pulsed magnetic fields; and iv) removing free surface-active agents and polarizing composition.

In another embodiment, the present approach is directed to producing a magnetic fluid comprising:

i) sedimentation of magnetic particles;

ii) mixing the magnetic particles with a) one or more surface-active agents;

b) one or more polarizing composition; and c) an aqueous acetic acid solution;

iii) applying pulsed magnetic fields;

iv) treating the mixture with a non-polar solvent;

v) treating the mixture with a polar solvent;

vi) removal of ferrite salts from the liquid; and vii) peptization of the stabilized magnetic particles in a non-polar fluid.

Preferably, the amount of excess surface-active agent that is removed in step (iv) is closely monitored and controlled. Steps (iv) and (v) result in the removal of excess surface active agent and polarizing composition by processing the magnetic particles first using a non-polar composition, and then a polar composition, with control of the extent to which excess surface active agent has been removed. In one embodiment, steps (iv) and (v) are combined as a single step.

Preferably, the mixing, applying and treating of parts (ii) through (v) are conducted with heat and stirring. Preferably, the mixture is heated to about 150° C. to about 160° C.

Magnetic particles are obtained by sedimentation of ferrous and ferric salts with about 6% aqueous ammonia. The magnetic particles are separated from the solution by decanting and repeatedly rinsing with distilled water until a pH of about 7 is reached. The magnetic particle sediment is then centrifuged and water-borne sediment of magnetic particles is brought to about 90° C. while stirring for about 30 minutes.

Separate from the magnetic particles, the surface-active agent is chemically polarized by addition of a polarizing composition. The mixture of the chemically polarized surface-active agent is kept at about 90° C. to about 160° C., preferably 150° C. to about 160° C.

Separate from the magnetic particles and the chemically polarized surface-active agent, a 40% by weight aqueous solution of acetic acid is heated up to about 90° C.

The magnetic particles, chemically polarized surface-active agent and the aqueous acetic acid are simultaneously mixed together and thoroughly stirred and heated to about 150° C. to about 160° C. Heating the mixture to this temperature causes the surface-active agent molecules to have greater kinetic energy which assists in chemosorption of surface-active agent onto magnetic particle surfaces. The thickness of magnetic particle protective film is about 2 to about 2.5 nm when this heating protocol is followed.

Figure 8:
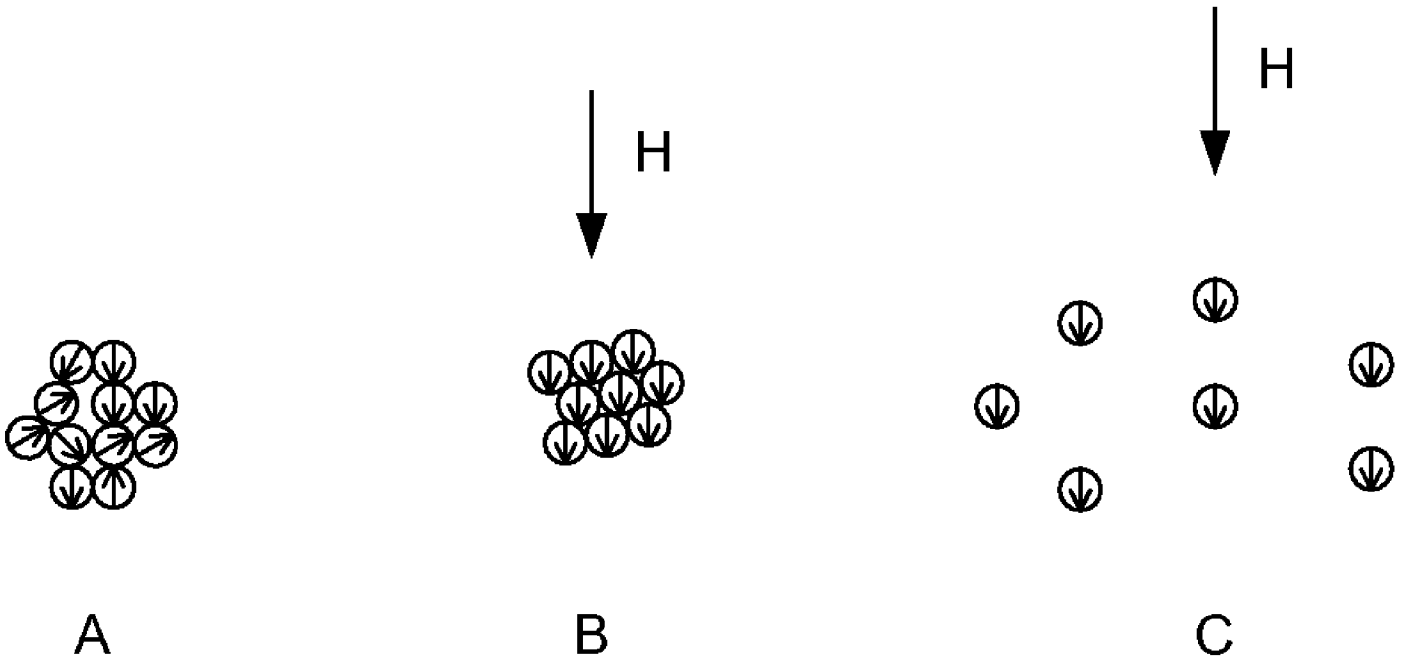
FIG. 8A depicts an aggregation of magnetic particles with randomly oriented magnetic poles.
FIG. 8B depicts the realignment of these magnetic particles and reorientation of the magnetic poles under the influence of an externally applied pulsed magnetic field.
FIG. 8C depicts the breaking up of the aggregate of magnetic particles into separate magnetic particles under the influence of an externally applied pulsed magnetic field.

In one embodiment of the present approach, the different components (i) magnetic particles, ii) surface-active agent, iii) polarizing composition, and iv) aqueous acetic acid) are simultaneously mixed under the presence of a pulsed magnetic field. This magnetic field achieves breaking down the magnetic particle agglomerations. The result is controlled according to the average size of magnetic particles which is defined by magnetic granulometry. See FIG. 8. The different components can be mixed together under the influence of at least 100 0.1-second-long impulses of magnetic field with an amplitude of about 0.3 Tesla.

After maintaining at a constant temperature and allowing coagulation of the sediment, the solution is decanted, and the stabilized magnetic particles are rinsed with hot distilled water until the electrical conductivity of the water used to rinse the stabilized magnetic particles are about the same as that of the hot distilled water.

The stabilized magnetic particles are then rinsed until all free (i.e., non-chemosorbed) surface-active agent and polarizing composition molecules are removed. This can be achieved by treating the sediment of stabilized magnetic particles first with non-polar, and then with polar solvents. For example, a non-polar solvent (e.g., hexane or heptane) is heated up to about 50° C. to about 70° C. and added to the sediment of the stabilized magnetic particles with continuous stirring. The polar solvent is added in the same manner as a non-polar solvent. Examples of polar solvents include ethyl ethers, acetone, ethyl alcohol, propyl alcohol, butyl alcohol, although use of acetone and ethyl alcohol is preferred.

Likewise, polar solvent (e.g., ethanol) is heated up to 50° C. and added to the ferrofluid with continuous stirring. Coagulation of the stabilized magnetic particles occurs, while surface-active agent and polarizing composition are removed by decanting the solution. The sediment of the stabilized magnetic particles is repeatedly treated with solvents until all free surface-active agent or polarizing compounds are removed. During rinsing, quantitative weight of surface-active agent in the decanted solution is monitored while trace alkalimetric test is performed.

After removal of all non-chemosorbed surface-active agent and all polarizing compounds, the stabilized magnetic particles are peptized in non-polar solvent. The peptization is usually accomplished at a temperature of 90° C. and simultaneous stirring, at a pressure of between 0.1 to 0.0001 bar, preferably 0.001 to 0.0001 bar.

EXAMPLES

Example 1

256 g of $FeCl_3.6H_2O$ dissolved in 2 liters of distilled water is mixed with 133 g of $FeSO_4.7H_2O$ dissolved in 2 liters of distilled water To the ferrite salt combination, about 4 liters of 6% aqueous ammonia is added to obtain a pH of about 11. Meanwhile, the colloidal magnetic particles are sedimented. The sediment is rinsed with distilled water whose pH=7. The magnetic particle sediment is centrifuged. The water-borne sediment of the centrifuged magnetic particles is maintained at a constant temperature with constant stirring at 90° C. for 30 minutes.

Separate from the magnetic particles, a mixture containing 22.5 g of stearic anhydride (surface-active agent), 22.5 g of stearic acid, and 22.5 g of butyl alcohol (polarizing compound) is formed. This mixture is stirred and warmed to 160° C.

This mixture along with 300 ml of 40% acetic acid aqueous solution heated to 90° C., and the magnetic particles (prepared above) are simultaneously stirred together while at least 100 0.1-second-long magnetic field impulses with about 0.3 Tesla amplitude are applied. These three components (i) magnetic particles, ii) chemically polarized surface-active agent mixture, and iii) aqueous acetic acid) are thoroughly stirred and maintained at a constant temperature until total coagulation of the stabilized magnetic particles is achieved, and the solution is decanted. Total coagulation time is about 10 minutes.

After draining the solution, the stabilized magnetic particles are rinsed with hot distilled water until electric conductivity of the drained water reaches that of the distilled water.

After that, the stabilized magnetic particles are treated with polar and non-polar solvents, until all excess surface-active agent and polarizing composition are removed. To remove this excess material, 100 mL of hexane heated up to about 30° C. to about 70° C. is added to the sediment of stabilized magnetic particles, accompanied by continuous stirring. The stabilized magnetic particles are peptized in hexane. 100 mL of ethyl alcohol (heated to about 50° C.) is stirred into the hexane-based ferrofluid. As the stabilized magnetic particles coagulate, excess (or free) surface-active agent and polarizing composition are extracted by the solution which is decanted. Treatment of the stabilized magnetic particles with polar and non-polar solvent is repeated until all excessive surface-active agent is removed.

During the treatment, the quantitative weight of surface-active agent in the decanted solution is monitored and tracked using an alkalimetric test. The monitoring is done by measuring the acidity of the solution after the addition of the polar solvent. The acidity depends on the nature of the components of the surface active ingredient and the polar solvent. The entire solution is poured into a beaker and is then titrated with a 0.1 N NaOH solution of alcohol in the presence of a phenolphthalene indicator, until the solution turns pinkish. The pink color is an indication of the completion of the reaction that neutralizes the acid groups. The amount of NaOH that has been neutralized is indicative of the amount of the components of the surface active ingredient and the polar solvent. The decanting is performed until the amount of free surface active ingredient and the polar solvent is no more than about 1 mg. This is usually within the range of uncertainty of the measurement, and indicates the absence of free surface active ingredient and the polar solvent.

After decanting the solution, the stabilized magnetic particles are peptized in carrier fluid at 90° C. by mixing under low pressure (about 0.1 to about 0.0001 bar) for 8 hours. The temperature during the peptization process can range from about 20° C. to about 90° C. Because the rate of removal of organic solvents and trace water proceeds faster at higher temperatures, preferably, the peptization occurs at about 70° C. to about 90° C. The mixer speed can be about 200 to about 1,200 rpm, preferably about 800 to 1,500 rpm. The peptizing fluid can be polyethilsiloxane fluids, kerosene or synthetic carbohydrate oils. Polyethylsiloxane fluids, such as those described by the general linear structural formula $M_2D_n$, where n is 1-8, M is $(C_2H_5)_3SiO_{0.5}$, and D is $(C_2H_5)_2SiO$, or synthetic olefinic polymer oil made of $C_5$-$C_{20}$ monomeric units can be used as the magnetic particle dispersing solution.

Example 2

The process as described in Example 1 was followed, but modified such that the surface-active agent is 15 g lauric anhydride and 15 g myristic anhydride in 15 g palmitic acid, which is used as a solvent for the anhydrides; and the polarizing composition is 22.5 g of butyl ether.

Example 3

The process as described in Example 1 was followed, but modified such that the surface-active agent is 15 g margaric anhydride in 15 g of enanthic acid and 15 g myristic acid; and the polarizing composition is 22.5 g hexyl alcohol.

Example 4

The process as described in Example 1 was followed, but modified such that the surface-active agent is 30 g palmitic anhydride in 15 g pelargonic acid; and the polarizing composition is 18 g oleic acid.

Example 5

The process as described in Example 1 was followed, but modified such that the surface-active agent is 15 g lauric anhydride and 15 g mystiric anhydride in 15 g palmic acid; and 45 g butyl ether is used as a polarizing composition.

Example 6

The process as described in Example 1 was followed, but modified such that the surface-active agent is 30 g lauric anhydride in 15 g margaric acid; and 27 g oleic acid is used as a polarizing composition.

Example 7

The process as described in Example 1 was followed, but modified such that the surface-active agent is 15 g lauric anhydride and 15 g myristic anhydride in 15 g palmic acid; and 31.5 g butyl ether is used as a polarizing composition.

Example 8

The process as described in Example 1 was followed, but modified such that the surface-active agent is 15 g margaric anhydride in 15 g enanthic acid; and 36 g heptyl alcohol is used as a polarizing composition.

Example 9

The process as described in Example 1 was followed, but modified such that the surface-active agent is 30 g palmic anhydride in 15 g pelargonic acid; and 40.5 g oleic acid is used as a polarizing composition.

Example 10

The process as described in Example 1 was followed, but modified such that the surface-active agent is 30 g margaric anhydride in 15 g caprylic acid; and 45 g valeric acid is used as a polarizing composition.

Example 11

The process as described in Example 1 was followed, but modified such that the surface-active agent is 30 g margaric anhydride in 15 g caprylic acid; and the polarizing composition is 22.5 g valeric acid.

Example 12

The process as described in Example 11 was followed, but modified such that the surface-active agent was heated to about 140° C.

Example 13

The process as described in Example 11 was followed, but modified such that the surface-active agent is heated to about 130° C.

Example 14

The process as described in Example 11 was followed, but modified such that the surface-active agent is heated to about 120° C.

Example 15

The process as described in Example 11 was followed, but modified such that the surface-active agent is heated to about 110° C.

Example 16

The process as described in Example 11 was followed, but modified such that the surface-active agent is heated to about 100° C.

Example 17

The process as described in Example 11 was followed, but modified such that the surface-active agent is heated to about 90° C.

The results of Examples 1-17 are summarized below in Table 2.

TABLE 2

Ferrofluids produced by the proposed method.

| Example | Average magnetic particle diameter, nm | Effective thickness of Protective film, nm |
|---|---|---|
| 1 | 7 to 8 | 1 to 1.5 |
| 2 | 7 to 8 | 1 to 1.5 |

TABLE 2-continued

Ferrofluids produced by the proposed method.

| Example | Average magnetic particle diameter, nm | Effective thickness of Protective film, nm |
|---|---|---|
| 3 | 7 to 8 | 1 to 1.5 |
| 4 | 7 to 8 | 2 to 2.5 |
| 5 | 7 to 8 | 2 to 2.5 |
| 6 | 7 to 8 | 2 to 2.5 |
| 7 | 7 to 8 | 2 to 2.5 |
| 8 | 7 to 8 | 2 to 2.5 |
| 9 | 7 to 8 | 2 to 2.5 |
| 10 | 7 to 8 | 2 to 2.5 |
| 11 | 7 to 8 | 2 to 2.5 |
| 12 | 7 to 8 | 2 to 2.1 |
| 13 | 7 to 8 | 2 |
| 14 | 7 to 8 | 2 |
| 15 | 7 to 8 | 1.9-2 |
| 16 | 7 to 8 | 1.9 to 2 |
| 17 | 7 to 8 | 1.8 to 1.9 |

The polarizing composition to surface-active agent ratio is preferably about 0.4 to about 0.6. Ratios of the polarizing composition to surface-active agent from 0.1 to 1 were tested. Ratios of 0.1 to 0.3 proved to be insufficient for breaking surface-active agent micelles and increasing its functional activity. The effective thickness of magnetic particle protective film for these ratios was 1-1.5 nm, and aggregate stability of obtained magnetic fluids was not very high. Ratios of 0.4 to 0.6, however, were found to be sufficient for breaking micelles and increasing surface-active agent functional activity. The effective thickness of magnetic particle protective film for these ratios was 2 to 2.5 nm. As the ratio was increased further from 0.7 to 1, the thickness of protective film remained the same. Thus, an optimum polarizing combination to surface-active agent ratio was determined as about 0.4 to about 0.6.

The proposed method allows production of ferrofluids with the parameters shown in Table 3.

TABLE 3

Ferrofluids.

| Ferrofluid properties | Proposed method | Conventional Art |
|---|---|---|
| Average size of magnetic particle, nm | 7 to 8 | 9 to 10 |
| Thickness of protective film, nm | 2 to 2.5 | 1 to 1.5 |

The proposed method allows production of magnetic fluids with aggregate stability that remains high during storage and under centrifugal and magnetic fields.

All publications mentioned above are hereby incorporated in their entirety by reference.

Having thus described embodiments of the invention, it should be apparent to those skilled in the art that certain advantages of the described method and apparatus have been achieved. It should also be appreciated that various modifications, adaptations, and alternative embodiments thereof may be made within the scope and spirit of the present invention. The invention is further defined by the following claims.

What is claimed is:

1. A method of making a magnetic fluid comprising:

(a) forming a mixture comprising a surface-active agent and a polarizing composition;

(b) adding magnetic particles to the mixture;

(c) after stabilization, removing the magnetic particles from the mixture and dispersing the magnetic particles in a carrier liquid; and wherein the polarizing composition comprises an alcohol.

2. The method of claim 1, wherein the surface-active agent is an anhydride of a $C_2$-$C_{20}$ fatty acid.

3. The method of claim 1, wherein the surface-active agent comprises any of stearic anhydride, lauric anhydride, margaric anhydride, palmitic anhydride, oleic anhydride, enanthic anhydride, myristic anhydride, pelargonic anhydride, caprylic anhydride, valeric anhydride, linoleic anhydride and mystiric anhydride.

4. The method of claim 1, wherein the mixture further comprises any of stearic acid, lauric acid, margaric acid, palmitic acid, oleic acid, enanthic acid, myristic acid, pelargonic acid, caprylic acid, valeric acid, linoleic acid, mystiric acid, butanoic acid, decanoic acid, elaidic acid, heptanoic acid, hexanedioic acid, hexanoic acid, isobutyric acid, isocaproic acid, isolavenic acid, n-butyric acid, nonanoic acid, octaduenoic acid, ricinoleic acid, undecanoic acid and unolic acid.

5. A method of making a magnetic fluid comprising:

(a) forming a mixture comprising a surface-active agent and a polarizing composition;

(b) adding magnetic particles to the mixture; and (c) after the magnetic particles have a layer of the surface-active agent on their surfaces, removing the magnetic particles from the mixture and dispersing the magnetic particles in a carrier liquid;

(d) wherein the polarizing composition to surface-active agent ratio is between about 1:1.66 and 1:2.5.

6. A magnetic fluid made by the method of claim 5.

7. The method of claim 5, wherein the magnetic particles comprise any of aluminum, barium, bismuth, cerium, chromium, cobalt, copper, dysprosium, erbium, europium, gadolinium, holmium, iron, lanthanum, lutetium, manganese, molybdenum, neodymium, nickel, niobium, palladium, platinum, praseodymium, promethium, samarium, strontium, terbium, thulium, titanium, vanadium, ytterbium, and yttrium.

8. The method of claim 5, wherein the carrier liquid is a polar solvent.

9. The method of claim 5, wherein the carrier liquid is a non-polar organic solvent.

10. The method of claim 5, wherein the carrier liquid is an organic solvent comprising any of kerosene, heptane, toluene, hydrocarbons, polyglycols, fluid siloxane containing block copolymer and combinations thereof.

11. The method of claim 5, wherein the carrier liquid is a polyethylsiloxane fluids described by the general linear structural formula $M_2D_n$, where n is 1-8, M is $(C_2H_5)_3SiO_{0.5}$, and D is $(C_2H_5)_2SiO$.

12. The method of claim 5, wherein the method further comprises adding surfactants and/or stabilizers.

13. A method of making a magnetic fluid comprising:

(a) forming a mixture comprising a surface-active agent and a polarizing composition;

(b) dispersing the magnetic particles in the mixture;

(c) after stabilization, removing the magnetic particles from the mixture and adding the magnetic particles to a carrier liquid; and (d) applying magnetic fields while the magnetic particles are in the mixture, wherein the magnetic fields have an amplitude of about 0.3 Tesla and a duration of at least 0.1 seconds.

14. A magnetic fluid made by the method of claim 13.

15. A method of making a magnetic fluid comprising:

adding magnetic particles to a surface-active agent and a polarizing composition;

applying magnetic fields to the magnetic particles;

removing the magnetic particles and dispersing the magnetic particles in a carrier fluid, wherein the magnetic fields have an amplitude of about 0.3 Tesla and a duration of at least 0.1 seconds.

16. A magnetic fluid made by the method of claim 15.

17. A method of making a magnetic fluid comprising:

(a) forming a mixture comprising a surface-active agent and a polarizing composition;

(b) dispersing the magnetic particles in the mixture; and (c) adding the magnetic particles to a carrier liquid, wherein the magnetic particles comprise any of aluminum, barium, bismuth, cerium, chromium, copper, erbium, europium, holmium, lanthanum, lutetium, manganese, molybdenum, neodymium, nickel, niobium, palladium, platinum, praseodymium, promethium, samarium, strontium, terbium, thulium, titanium, vanadium, ytterbium, and yttrium.

18. A magnetic fluid made by the method of claim 17.

* * * * *